United States Patent [19]

Droz

[11] Patent Number: 4,560,133

[45] Date of Patent: Dec. 24, 1985

[54] DISPLAY UNIT FOR JEWELRY ARTICLES

[75] Inventor: François Droz, La Chaux-de-Fonds, Switzerland

[73] Assignee: Brevex Georges Claude S.A., La Chaux-de-Fonds, Switzerland

[21] Appl. No.: 411,888

[22] Filed: Aug. 26, 1982

[51] Int. Cl.[4] ..... A47F 7/02

[52] U.S. Cl. ..... 248/442; 248/448; 248/116

[58] Field of Search ..... 248/442, 448, 114–116, 248/450, 451, 459, 460, 172, 174; 40/305, 306, 309, 310, 586, 21 C

[56] References Cited

U.S. PATENT DOCUMENTS

| | | | |
|---|---|---|---|
| D. 135,786 | 6/1943 | Grivin | 248/459 |
| 1,687,205 | 10/1928 | Hamlin | 248/442 |
| 1,877,532 | 9/1932 | Reitz | 248/116 |
| 2,421,253 | 5/1947 | Fleischner | 248/442 |
| 2,549,369 | 4/1951 | Epstein | 248/116 |
| 3,208,713 | 9/1965 | Eichhorn | 248/451 |
| 3,809,338 | 5/1974 | Gross, Jr. | 248/115 |
| 4,154,011 | 5/1979 | Rakestraw | 40/21 C |
| 4,328,978 | 5/1982 | McLaughlin | 40/21 C |

FOREIGN PATENT DOCUMENTS

| | | | |
|---|---|---|---|
| 831501 | 2/1952 | Fed. Rep. of Germany | 248/116 |
| 844113 | 7/1952 | Fed. Rep. of Germany | 248/116 |
| 216083 | 7/1941 | Switzerland | 248/114 |
| 260754 | 3/1949 | Switzerland | 248/114 |
| 588400 | 5/1947 | United Kingdom | 248/442 |

*Primary Examiner*—J. Franklin Foss
*Assistant Examiner*—Robert A. Olson
*Attorney, Agent, or Firm*—Werner W. Kleeman

[57] ABSTRACT

A display unit for jewelry articles of substantially circular shape is disclosed comprising a small plate which is fabricated with a band or strip. This band is cut out from a strip of flexible material possessing good elasticity. At the small plate there is formed an opening or slot or the like to allow for the passage of the jewelry article which is to be displayed, for instance a bracelet, wrist watch, necklace or ring. In this manner, the small plate is located outside the ring or annular body formed by the jewelry article where it can serve to support the most different data concerning this jewelry article, and the band or strip is wrapped-up around the interior of the jewelry article. Owing to its elasticity, the band or strip supports the jewelry article which, if necessary, can then be set on a shelf of a display window.

12 Claims, 13 Drawing Figures

Fig. 1
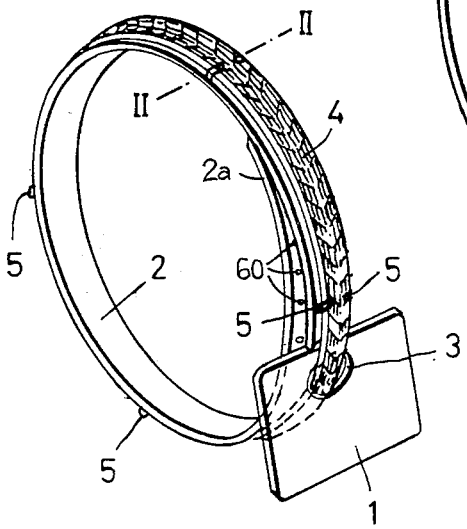
Fig. 4
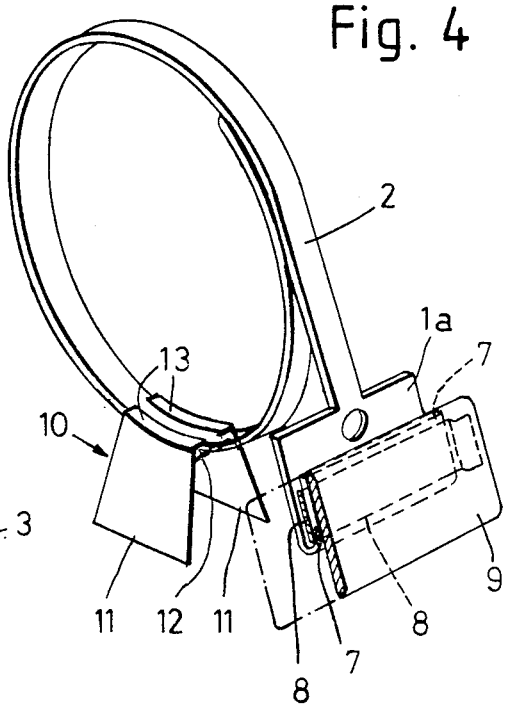
Fig. 3
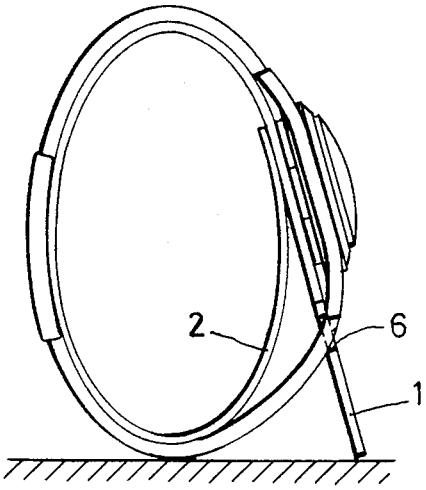
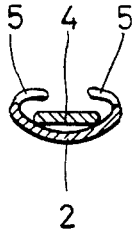
Fig. 2
Fig. 5
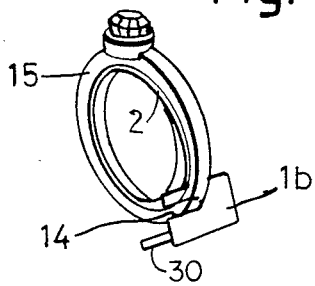

DISPLAY UNIT FOR JEWELRY ARTICLES

BACKGROUND OF THE INVENTION

The present invention relates to a new and improved construction of display unit or device for attractively and reliably displaying different jewelry articles, such as a wrist watch, bracelet, ring or necklace, and which is intended to support the article in a raised position, for instance, on a shelf of a display window.

Display units or devices of this type are well known in the art and are especially provided for wrist watches. They consist essentially of an open loop or ring which, in its natural state, is slightly larger than the internal circumference of the article of jewelry which is to be displayed with its armband or bracelet in a closed position. This loop or ring is fabricated with several appendages which allow, among other things, laying the loop or ring in a stable and stationary manner on a display window shelf, in a perpendicular position in relation to the shelf, and to secure to it a small plate carrying the data or specifications, the brand name or mark and so forth of the displayed watch or the like.

The loop or ring of these known display units only allows for small deformations, since it is fabricated, along with its appendages, of a relatively rigid material. Considering the small elasticity of these display units, different dimensions are generally required for men's watches and for women's watches. On account of the form of the display units known to the art, their fabrication is relatively complicated. The storage of these display units takes up a considerable amount of space, and their transportion requires the manufacture of voluminous packages Moreover, they only allow for the watches to be displayed with their bracelet closed and in a substantially vertical plane or upright elevational position. Finally, the small plate which is attached to the display unit must be of relatively small dimensions, so that it will not screen or obstruct the displayed article, and thus, the number of possibilities that it affords is very limited.

SUMMARY OF THE INVENTION

Therefore, with the foregoing in mind, it is a primary object of the present invention to provide a new and improved construction of display unit for jewelry articles which is not associated with the aforementioned drawbacks and limitations of the prior art proposals.

Another and more specific object of the present invention aims at providing a new and improved construction of display unit for jewelry articles wherein the nature of its constituent parts makes its fabrication easier.

Still a further significant object of the present invention is directed to an improved display device for articles of jewelry utilizing an elastic band or strip as a component thereof, wherein the elasticity of such band or strip renders it possible to display the most different articles in a highly efficient, simple and attractive manner.

Yet a further important object of the present invention is to provide an improved construction of display unit for jewelry articles wherein there is an absence of fixed appendages or the like which allows such display units to be stacked in an increased number and while occupying a reduced amount of space or volume, and thus simplifying the transportation thereof.

A further object of the invention is to devise an improved construction of display unit for the displaying of various articles, particularly jewelry articles, employing as part of the display unit a flexible band or strip which can be fabricated in a most simple fashion by cutting-out the same from a tape or ribbon of a roll of material.

Now in order to implement these and still further objects of the invention, which will become more readily apparent as the description proceeds, the display unit for displaying various articles of jewelry, such as a wrist watch, bracelet, ring or necklace, in order to support such jewelry article, for instance, in a raised position upon a shelf of a display window, comprises a small plate which is capable of carrying thereon data and other specifications relative to the displayed article of jewelry. The small plate is provided with a band formed of a flexible material having good elasticity. This band, in its reposing or rest position, in other words in its position where it is not flexed into a configuration to support the article, is substantially rectilinear. The band is intended to be applied against the internal face or side of the jewelry article to be displayed in a desired position thereof and thus supports such jewelry article. The band is fixedly connected with, for instance, formed of one-piece or integrated with the small plate in a manner such that this small plate assists the band in supporting the article in a desired raised position.

The display unit can be used to advantage to support articulated articles of jewelry. Moreover, the band may have a length which exceeds that of the internal face of the article of jewelry which is to be displayed. This provides for an exceedingly simple construction of the display unit. Moreover, the band or strip of the display unit can have substantially the same width from one end thereof to the other, inasmuch as its elasticity or resiliency, which tends to urge it into a flat condition, is generally sufficient for positively retaining and holding the article which is to be displayed.

However, if the elasticity of the band or strip must be sufficient for supporting the weight of heavier articles, then it would be possible to design the display unit such that the band, starting at a point close to one of its extremities or ends and extending over a certain length thereof, possesses a series of latching elements, such as for instance protrusions, depressions or openings. The other free end or extremity of the band or the like is then configured in such a way as to be able to coact with such latching elements, and thus, to be blocked by one or another of such latching elements, which as mentioned may be protrusions, depressions or openings for instance.

When the display unit is particularly used for displaying articles of jewelry in the form of necklaces, then the band can be structured to form a guide channel and possesses coacting pairs of catches or stops distributed in spaced relationship along the edges of the band, in order to laterally retain in place the article of jewelry which is to be displayed and which is then usually straight and narrow.

According to a further concept of the invention the small plate can be rigidly connected to or formed of one-piece with one end or extremity of the band, so that it retains the band along with the article of the jewelry to be displayed in an essentially vertical position. The small plate possesses an opening which allows for the passage therethrough of the article which is to be displayed. Hence, the display unit or device allows for the display of a piece of jewelry in the same position as display units of the prior art.

If the small plate which is integrated with or connected to the band or strip of the display unit occasions undesirable tilting or shifting of the article to be displayed towards the rear, because of its dimensions, then it would be possible to stabilize the display unit by providing a support element in the form of a slide member or the like which forms a support or stand. This slide member advantageously engages the band in order to raise a lower part of the jewelry article to be displayed.

Additionally, it is possible for the small plate to possess an opening which extends up to one of the lateral edges or borders of the small plate, in order to allow the sliding-in of an article of jewelry in the form of a closed loop or annular member. Such display unit is particularly suitable for displaying rings.

When it is desired to display the articles of jewelry in a horizontal position the small plate may be rigidly connected laterally to the band, in order to hold the band and the jewelry article to be displayed at an extremely flat oblique angle.

Equally, if it is desired to display the jewelry article in a spread-out condition, then the face or side of the band opposite to that face intended to be placed against the jewelry article to be displayed can be provided with a series of substantially equidistantly arranged latching elements, typically protrusions, depressions or openings. A second band, similar to the first band, is then attached to the first band by a series of coacting latching elements complementary to the latching elements, namely the protrusions, depressions or openings, provided at the first band. The distance between the latching elements of the second band differs slightly from the distance between the latching elements of the first band, according to the curvature or bend that the first band must assume, and the second band fixedly retains the first band in accordance with the desired curvature.

Finally, it is possible for the small plate to be fabricated with a small projection which protrudes from one of its lateral edges or borders and serves to support a tubular element which, for instance, may bear the price of the displayed article. In this way it is possible to closely associate the price of the article with the article which is actually being displayed, and also to repeatedly use in succession the same display unit for articles having different prices.

BRIEF DESCRIPTION OF THE DRAWING

The invention will be better understood and objects other than those set forth above, will become apparent when consideration is given to the following detailed description thereof. Such description makes reference to the annexed drawings wherein:

FIG. 1 is a perspective view of the first embodiment of the invention;

FIG. 2 is a sectional view taken substantially along the line II—II of the showing of FIG. 1;

FIG. 3 is a side view of a second embodiment of display unit according to the invention;

FIG. 4 is a perspective view of a third embodiment of display unit according to the invention;

FIG. 5 is a perspective view of a fourth embodiment of display unit according to the invention;

DETAILED DESCRIPTION OF THE PREFERRED EMBODIMENTS

Figure 6:
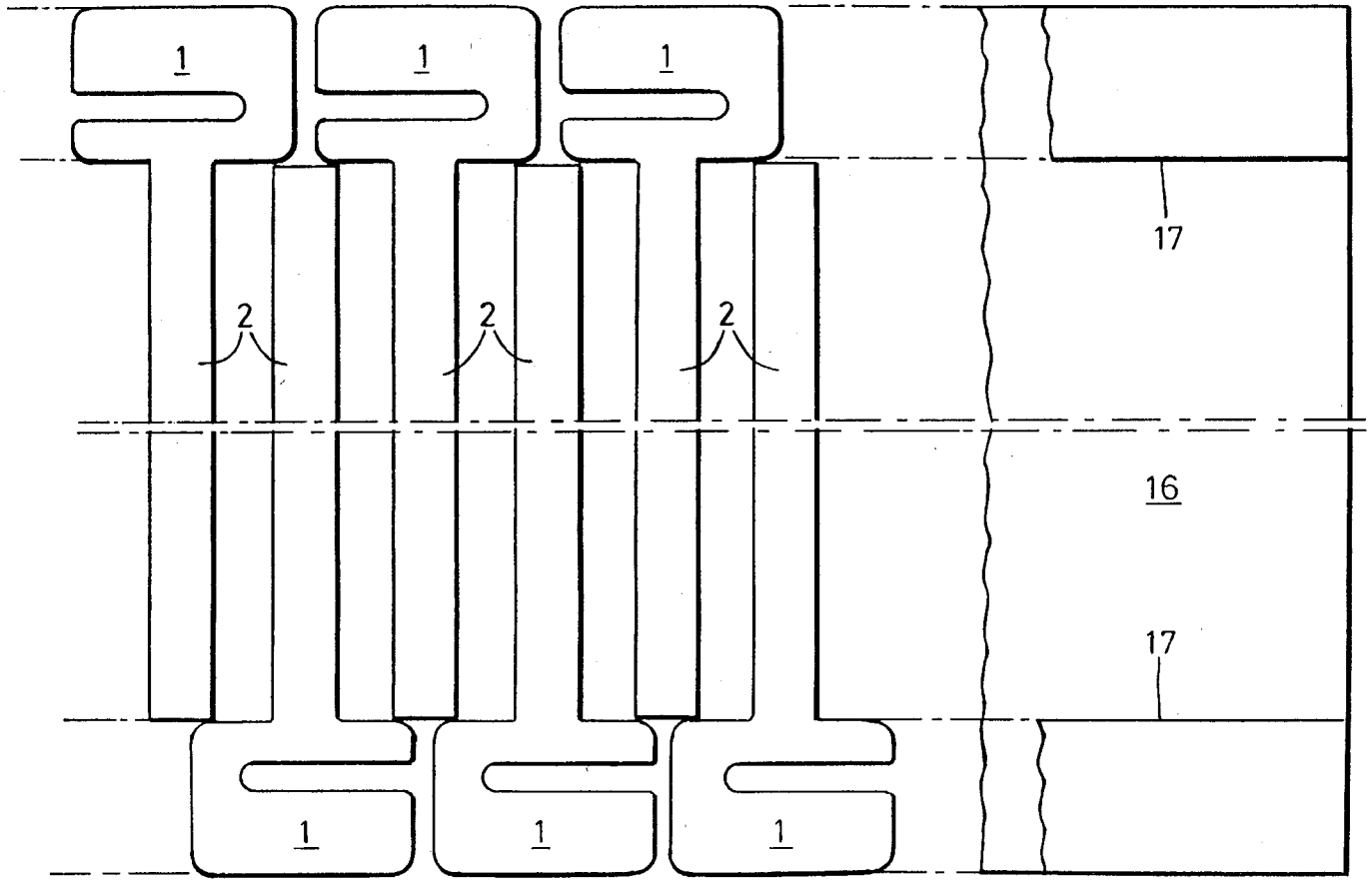
FIG. 6 illustrates a mode of fabrication of the display unit according to the invention.

Describing now the drawings, the exemplary embodiment of display unit or device for displaying articles of jewelry and illustrated in FIGS. 1 and 2 is intended for use with necklaces for instance. It is composed of a small plate 1 constructed to possess a band or strip 2. In its natural state, the band 2 is rectilinear, i.e. lies in a substantially flat rectangular configuration. This band 2 and the small plate 1 are fabricated of a material such that the band or strip 2 is flexible and has good elasticity. Materials which are suitable for this purpose are, for instance, polystyrene, polypropylene and polyvinylchloride.

The small plate 1 possesses an opening or hole 3 which is large enough so that the necklace 4, which is to be displayed, can suitably pass through this opening or hole 3 before it is closed. The passage of the necklace 4 through the opening or hole 3 is accomplished in such a way that after closing the necklace 4, the small plate 1 remains at the exterior of the necklace 4 and the band or strip 2 extends towards the inside or interior of the necklace 4. This band or strip 2 is then applied against the internal side or face (FIG. 1) of the necklace 4, that is to say, against its side or face which, when the necklace is worn, reposes against the body of the user. Owing to the elasticity or resilient properties of the band or strip 2, the necklace 4 is firmly supported and held by this band 2 of the display unit.

To avoid the possibility of the necklace 4 falling off the retaining band or strip 2, the latter is advantageously constructed to be concave or otherwise appropriately curved between its lateral edges or borders along its entire length, in such a manner that its side or face directed towards the outside or exterior is concave, as clearly shown in the illustration of FIG. 2. With this construction, the concavely curved band 2 forms a guide channel for the jewelry article, here the necklace 4, to be displayed. Moreover, the lateral edges or borders of the band or strip 2 are equipped with catches or stops 5 at appropriately spaced intervals along the length of the band 2, as shown in FIG. 1.

In relation to the length of the internal face or side of the necklace 4, the band or strip 2 is chosen to be slightly longer, so that it appropriately winds or coils around itself within the interior of the necklace, as shown in FIG. 1. The necklace 4 and its display unit or device 1, 2 can then be placed in a substantially vertical elevational position upon the window display shelf or the like (not shown), in such a manner that both the lower border or edge of the small plate 1 and the lower part of the necklace 4 repose upon such display shelf. The reposing or supporting action provided at these two places ensures for the complete stability of the entire assembly in the direction of or a plane containing the longitudinal axis of the necklace 4, and the small plate 1 ensures for the stability of the entire assembly in a perpendicular plane.

The markings or other inscriptions or data concerning the nature of the materials from which the necklace is formed, its ornamentation, and possibly its source or origin or brand name or trademark can suitably appear on the small plate 1, which preferably should be inscribed as heretofore described.

If the weight of the necklace 4 is such that the elasticity of the band or strip 2 is not sufficient to support it in the position described and shown in the drawings, it would be adequate if there is prevented that the free end 2*a* of the band 2 slides along the internal face of this band 2. For this purpose, a series of suitable latching elements, such as protrusions, depressions or openings, merely generally schematically represented by reference numeral 60 in FIG. 1, could be provided for the band 2 starting at some point after the small plate 1 and the free end 2*a* of the band 2 could be appropriately constructed in such a manner as to fasten or latch with one of these protrusions, depressions or openings 60.

Display units or devices of the type mentioned at the beginning of this disclosure, which are used most frequently, are intended for use with wrist watches, as is specifically the case for the construction of display unit according to the embodiment represented in FIG. 3. This display unit, however, only differs from the first construction described above with reference to FIGS. 1 and 2 in the length of the band or strip 2, which is adapted to the length of the bracelets or arm bands, and in the fact that the opening of the small plate 1, instead of being constituted by a circular hole 3 as shown in FIG. 1, consists of an elongated slit or slot 6. This elongated or extended slot 6 can be provided at the central region of the lengthwise extent of the small plate 1, so that it can allow the passage of one of the ends of the still open bracelet or arm band of the watch. A slit or slot 6 extending up to one of the lateral edges or borders of the small plate 1 can, however, also be provided for the latter, much in the manner of the slot 14 of the arrangement of FIG. 5. The closed bracelet can then be made to slide into this open slit or slot 6.

The third embodiment of display unit or device which is shown in FIG. 4 differs from the preceding described embodiment in that it is constructed and arranged in such a way as to permit the use of the known small plates bearing the data or other specifications of the displayed jewelry piece. To this end, the lower border or edge 7 of the small plate 1*a* of the modified design of display unit constructed according to the invention and shown in FIG. 4, is turned-in or flexed towards the top of the small plate 1*a*. Thus, there is formed a hook in which there can be frictionally engaged the loop or nose 8 or the like of a conventional small plate 9. Depending upon the means of engagement or the hook provided in the small plate 9, it is evident that the small plate 1*a* could be provided with corresponding or complementary means different from the constructions heretofore described. The small plate 1*a* could even be dispensed with, and the small plate 9 could be set directly upon the extremity or end of the band 2.

Considering the dimensions of these conventional small plates, it could happen that the small plate 9, mounted in the described fashion, could produce an undesirable tilting or shifting towards the rear of the displayed jewelry piece. A position stabilizing support or stand 10, for instance in the form of the depicted slide member, permits mitigating against this inconvenience. The slide-like stabilizing support or stand 10 is slidingly mounted upon the band 2 of the display unit. This stabilizing support or stand 10 comprises two obliquely extending or inclined leg members or flanks 11 on both sides of a face 12 which is brought to bear substantially flat upon the external surface of the band 2 with the aid of two catches or engaging members 13 which engage with the opposed borders or edges of the band 2. The slide-like stabilizing support or stand 10 is placed along this band in such a way that it raises the lower part of the bracelet of the jewelry piece displayed, and thus, compensates for the raising of the small plate 1*a* of the inventive display unit caused by the small plate 9.

A further embodiment of display unit as shown in FIG. 5 is contemplated for use with rings. In this case, the small plate 1*b* of the display unit possesses an open slit or slot 14 which extends up to the region of one of its lateral edges or borders, to permit sliding therein of the displayed ring 15. As to the band or strip 2 of this display unit, it obviously possesses a width and above all a length adapted to the dimensions of the rings intended to be displayed.

The fabrication of the display units heretofore described can be easily accomplished as now will be described in conjunction with the illustration of FIG. 6. A series of display units 1, 2 can be, in effect, cut-out from a band or sheet 16, stocked in rolls and introduced into an automatic cutting press or machine.

So as to make the small plates 1 of the display units according to the invention look attractive, decorative ribbons or tapes 17, made of cloth, leather or plastic material can be placed upon the edges or borders of the band or sheet 16. By placing such decorative ribbons 17 or the like onto the two faces of the band or sheet 16, it is even possible to be able to use the two faces of the display units according to the invention, each of these display units then enabling displaying two different articles. The data or other specifications or information concerning the displayed article can be provided by using, for instance, a decal or the like which is applied onto the ribbons 17. Depending on the desired use of the display unit, it would also naturally be possible to dress or cover the bands 2 with a decorative ribbon.

It is not absolutely necessary that the small plate connected to the band or strip of the display units according to the invention, be situated at the extremity or end of this band. It also can be laterally connected, as is the case for the embodiment of display unit or device illustrated in FIGS. 7 to 9. In this case, the band or strip 18 is fabricated to possess an arm 19, extending perpendicularly to the band 18, from a point located at one of its lateral edges or borders. The small plate 20 itself is fabricated as an integrated member with the arm 19. As a variant, this small plate 20 could equally be connected to the extremity or end of the laterally depending arm or arm member 19, as indicated by the broken lines in FIG. 9.

Figure 7:
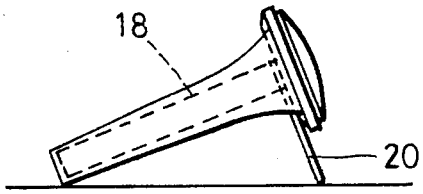
FIG. 7 is a side view of a fifth embodiment of display unit according to the invention.
Figure 8:
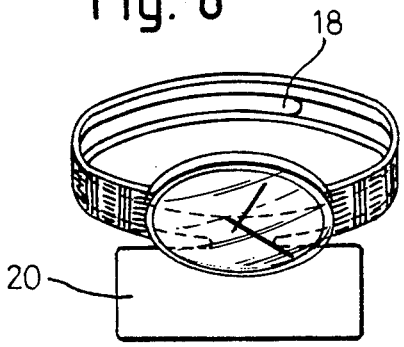
FIG. 8 is a perspective view of the display unit shown in FIG. 7.
Figure 9:
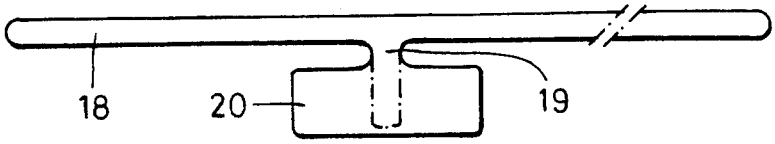
FIG. 9 is a top plan view of the display unit illustrated in FIGS. 7 and 8, also illustrating a variant.

In this constructional embodiment, the band 18 is contemplated to be rolled-up onto itself in the interior of the closed watch arm band or bracelet (FIGS. 7 and 8). The display units according to this embodiment maintain the watch slightly raised, but in a predominantly lying or reposing position.

Figure 10:
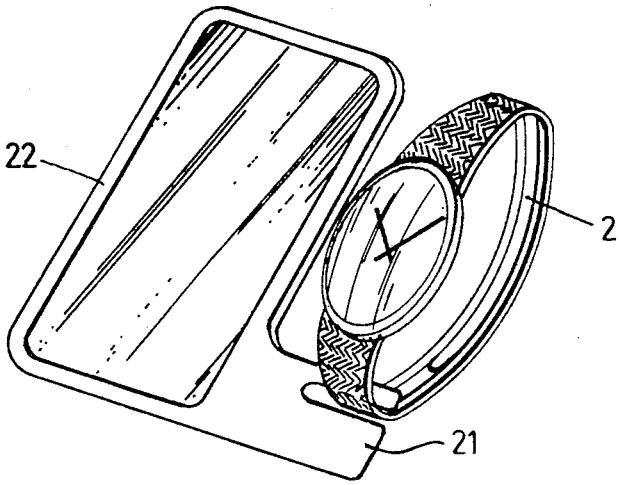
FIG. 10 is a perspective view of a sixth embodiment of display unit according to the invention.

The place available for the markings or indicia concerning the displayed jewelry piece is not limited to the dimensions dictated by the support function of the band of the display unit according to the invention imposed by the small plates of the five embodiments heretofore described. The further embodiment of display unit or device illustrated in FIG. 10 demonstrates that the small plate 21, which supports the band or strip 2, obviously can be fabricated without complications, for instance cut-out so as to be provided with a frame 22 which is capable of receiving a great number of markings or indicia for the article to be displayed.

Finally, the display unit or device according to the invention is not contemplated solely for supporting jewelry articles forming a closed loop or ring. The display unit according to the embodiment depicted in FIGS. 11 to 13 serves to display a watch with its bracelet in a stretched or laid open position. Such construction of display unit comprises a first band 23 which, in its rest or completely reposing position where it is not yet positioned to display the article, is substantially rectilinear in configuration, like in the preceding embodiments. On its side or face opposite to that side or face which is applied against the watch band or bracelet, the band 23 possesses a series of essentially equidistant small projections 24, as also indicated by the arrows a—a. A second band 25, possessing a series of complimentary holes or openings 26, is attached to the first band 23 by the engagement of the mentioned small projections or latching protuberances 24 in the latching holes 26.

Figure 11:
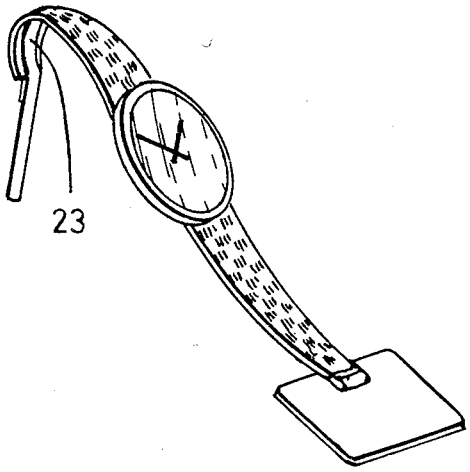
FIG. 11 is a perspective view of a seventh embodiment of display unit according to the invention.
Figure 12:
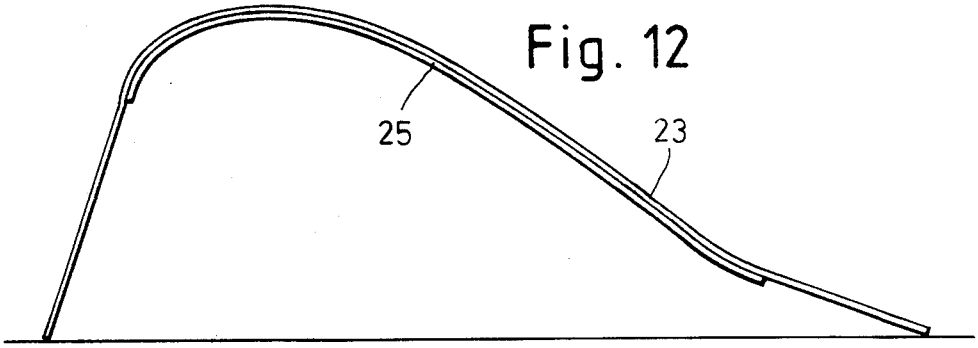
FIG. 12 is a side view of the display unit illustrated in FIG. 11.
Figure 13:
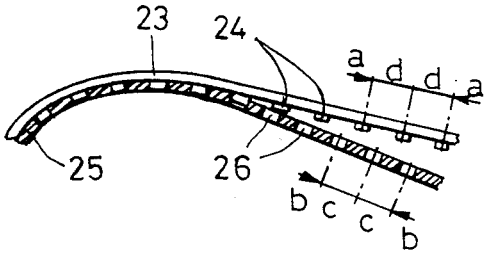
FIG. 13 illustrates a detail of the display unit of FIG. 12, shown on an enlarged scale.

So as to render the band 23 substantially rigid in the curved configuration represented in FIGS. 11 and 12, the latching holes 26 are not equidistant. Where the band 23 must be convex beneath the part of the bracelet to be supported, the distance c, c, indicated by the arrows b—b, between the latching holes 26 is smaller than the distance d,d between the latching projections or protuberances 24, and where the band 23 must be concave beneath the bracelet, the distance c, c between the latching holes 26 is slightly greater than the distance d, d between the latching projections 24.

To allow for a close association of the price of the displayed article to the actual article itself, the small plate 1 (1*a*, 1*b*, 20, 21) of the display units or devices according to the invention, as specifically shown for the embodiment illustrated in FIG. 5, could be fabricated with a small projection 30 protruding from one of its lateral edges or borders, onto which there could be made to slide a tubular element carrying the price of the displayed article.

According to other possible embodiments which have not been particularly shown, the small plate could be attached to more than one band, by cutting the bands and plate in one-piece or by mounting or gluing such plate to the bands. Two bands could be, for example, attached to one and the same small plate and extend parallelly or perpendicularly to each other in order to display two watches together, either next to each other or one in a standing position and the other in a lying or reposing position.

While there are shown and described present preferred embodiments of the invention, it is to be distinctly understood that the invention is not limited thereto, but may be otherwise variously embodied and practiced within the scope of the following claims. Accordingly,

What I claim is:

1. A display unit for a jewelry article, such as a wrist watch, bracelet, ring or necklace, in order to support the displayed article in a raised position on a shelf of a display window, comprising:

a small plate capable of carrying data concerning the display article;

a band rigidly connected at one end region thereof with said small plate;

said band having a free end portion located at an opposite end of said band remote from said one end region;

said band being fabricated of a flexible material having good elasticity;

said band being selectively positionable from a rest position where it does not support the article to be displayed into an operative position where it is capable of supporting the article to be displayed;

said band in said rest position being substantially rectilinear in its configuration; and said band being sufficiently flexible and forming in said operative position a loop with said free end portion of said band directly and circumferentially engaging a predetermined portion of said band at an inner surface thereof such that said loop is capable of being applied against an internal face of the article which is to be displayed so as to be capable of supporting said article in a desired display position.

2. The display unit as defined in claim 1, wherein:

said small plate and band are formed of one-piece.

3. The display unit as defined in claim 1, especially for supporting jewelry articles forming a closed loop, wherein:

said band, starting at a point near one of its extremities and for a certain length thereof, possesses a series of latching elements; and the other extremity of said band being latched with a selected one of said latching elements such that the other extremity is blocked against performing any sliding movement relative to said one extremity.

4. The display unit as defined in claim 3, wherein:

said latching elements comprise projections; and said other extremity of said band latching with a selected one of said projections.

5. The display unit as defined in claim 3, wherein:

said latching elements comprise depressions; and said other extremity of said band latching with a selected one of said depressions.

6. The display unit as defined in claim 3, wherein:

said latching elements comprise openings; and said other extremity of said band latching with a selected one of said openings.

7. The display unit as defined in claim 1, wherein:

said small plate retains said band in a substantially vertical elevational position; and said small plate possessing an opening through which there is capable of passing the article to be displayed.

8. The display unit as defined in claim 7, further including:

slide means forming a supporting stand and slidably engaging with said band; and said supporting stand raising a lower part of said band in said vertical elevational position of said band in order to compensate for excessive elevation of said band caused by the small plate.

9. The display unit as defined in to claim 7, wherein:

said openings of said small plate extends up to one of its lateral edges, in order to allow the slideable insertion therein of a jewelry article forming a closed loop.

10. The display unit as defined in claim 1, wherein:

said small plate is fabricated with a small projection projecting from one of its lateral edges and serving for supporting a tubular element holding the price of the displayed article.

11. The display unit as defined in claim 1, wherein:

said band supporting the article to be displayed defines a front side; and said small plate being located at the front side of said band supporting the article to be displayed.

12. The display unit as defined in claim 1, wherein:

said small plate is provided with a hook-shaped member;

a further small plate being attached to said small plate by means of said hook-shaped member; and said small plate and said further small plate supporting said band in said desired display position.

* * * * *